United States Patent [19]

Rogers et al.

[11] 4,233,600

[45] Nov. 11, 1980

[54] METHOD AND SYSTEM FOR DETECTING PLATE CLASHING IN DISC REFINERS

[75] Inventors: James H. Rogers, Beaconsfield; Donald J. Butler, Grand Falls, both of Canada

[73] Assignee: Pulp and Paper Research Institute of Canada, Pointe Claire, Canada

[21] Appl. No.: 913,409

[22] Filed: Jun. 7, 1978

[51] Int. Cl.[3] ..... G08B 21/00

[52] U.S. Cl. ..... 340/683; 241/33; 241/37

[58] Field of Search ..... 340/683; 241/33, 37, 241/244

[56] References Cited

U.S. PATENT DOCUMENTS

| | | | |
|---|---|---|---|
| 2,235,928 | 3/1941 | Hardinge | 340/683 |
| 2,799,015 | 7/1957 | Bell | 340/683 |
| 3,799,456 | 3/1974 | Jewell et al. | 241/37 |
| 3,836,854 | 9/1974 | Wehman | 340/661 |
| 4,073,442 | 2/1978 | Virving | 241/37 |

*Primary Examiner*—Glen R. Swann III

*Attorney, Agent, or Firm*—Millen & White

[57] ABSTRACT

A refiner plate clash detection system and method for plate clash detection is provided herein. The system includes a receiver for a first signal having a significant increase in level at at least one distinct predetermined frequency related to the clash and the characteristics of the discs of the refiner. A filter is provided having a passband matched to pass the distinct frequency of the signal to provide a filtered output signal in which the center frequency of the passband of the filter is determined by the formula $$f_o = n\Sigma_R$$

wherein $f_o$ is the center frequency (expressed in Hertz) of said passband n = the number of segments at a given radius, per single disc and $\Sigma_R$ = the sum of the rotational rates (expressed in Hertz) of the two discs enclosing a given refining volume.

The filtered signal is then smoothed. A threshold level is established. A comparator is provided for receiving the smoothed signal and for comparing it with the threshold level, and for providing an output signal of predetermined form, when the smoothed signal exceeds the threshold level. A receiver is provided for receiving the output signal for generating an alarm operation signal in response thereto. Protection can be automatically initiated by the plate clash detection system; alternately, it can be done manually by an operator, using the detection system as a warning device.

10 Claims, 3 Drawing Figures

METHOD AND SYSTEM FOR DETECTING PLATE CLASHING IN DISC REFINERS

BACKGROUND OF THE INVENTION

1. Field of the Invention

This invention relates to a method and means for the detection of plate clashing in disc refiners. Such refiners are used for processing a material, e.g., a pulp suspension or a mixture of wood chips, water and chemicals.

2. Description of the Prior Art

A disc refiner includes two discs at least one being rotatable relative to the other and forming between them a narrow, slot-shaped chamber. Each disc is an assembly of wedge-shaped segments bolted or otherwise secured to the surface of a circular plate holder; the number of segments per disc is specific to the refiner type. The discs are so arranged that they are displaceable toward and away from one another for adjustment of the size of the chamber and the resulting pressure exerted on the material being refined. Under load, the refining pressure forces the material in the chamber into the form of a pad which prevents destructive contact between the two refiner plates. Should the pulp pad break down, due either to process or to machine disturbances or machine failure, plate contact can occur until the pad reforms, the operator releases the plate pressure, or the attendant change in motor load causes the load protection circuits automatically to open the plates. The degree of damage incurred by the plates during the contact period (dependent upon the contact pressure and the period's duration) determines whether they then have to be replaced with a new set. Plate replacement is often necessary.

The capacity of refining units is rapidly increasing and the cost of plate replacement is closely following this same trend. Downtime on a single unit is giving rise to both larger process disturbances and production losses.

At the present time, no effective means exists for anticipating an imminent clash, or for early detection once it occurs, that is suitable for industrial application. A refiner operator can, with careful attention hear the sound of metal-to-metal contact during a clash. His effectiveness, however, varies according to the resident environmental noise and the type of refiner casing. Often, the operator is not near enough to the refiner to hear the emitted sounds and, if they are heard, it is difficult to initiate preventative action before plate damage occurs.

General purpose electronic equipment is available for sound and vibration analysis. Two categories of equipment which are available include on-line real-time signature analyzers, and machine protection systems. Neither of these systems has, as yet, been used for plate clash protection, and both have serious drawbacks that limit their applicability in this area. On-line signature analyzers are used for the characterization of input signals. They suffer from both high cost and complexity. Plate clashing develops rapidly; signature analyzers do not permit input data to be analyzed quickly enough to allow preventative action to be taken before destructive plate damage occurs. There is no facility for the automatic detection of the relevant phenomena nor for preventative action. Machine protection systems do not have the selectivity required for singling out clash data in an accurate and consistent manner. Thus, the pecularities of the monitored signal, during periods of plate clash, are not readily identifiable with such equipment. Peak detection, upon which machine protection systems depend, is highly erratic due to the nature of the clash phenomena.

SUMMARY OF THE INVENTION

1. Aims of the Invention

Consequently, an object of a broad aspect of the present invention is to provide a consistent and reliable means for the early detection of the plate clash phenomena so that preventive action can then be taken to minimize plate damage and reduce process upsets.

2. Statements of Invention

The present invention is predicated on the use of the energy level in either the vibration or the acoustic signal from a refining unit to warn of plate clashing. Consequently, by a broad aspect of this invention, a refiner plate clash detection system is provided, comprising (a) means for receiving a first signal having a significant increase in level at at least one distinct predetermined frequency related to the clash and the characteristics of the discs of the refiner, filter means having a passband matched to pass said distinct frequency of said signal to provide a filtered output signal in which the center frequency of the passband of the filter is determined by the formula $$f_o = n^{\Sigma}{}_R$$

wherein $f_o$ is the center frequency (expressed in Hertz) of said passband n = the number of segments at a given radius, per single disc and $\Sigma_R$ = the sum of the rotational rates (expressed in Hertz) of the two discs enclosing a given refining volume, means for smoothing said filtered signal, means for establishing a threshold level, comparator means for receiving said smoothed signal and for comparing it with said threshold level and for providing an output signal of predetermined form, upon said smoothed signal exceeding said threshold level, and means for receiving said output signal for generating an alarm operation signal in response thereto.

This invention also provides a refiner plate clash detection system comprising: means for receiving a first signal having a significant increase in level at at least one distinct predetermined frequency related to the clash, the number of segments at a given radius of a single disc and the rotational rates of the discs, filter means having a passband matched to pass said distinct frequency of said signal to provide a filtered output signal, means for smoothing said filtered signal, means for establishing a threshold level, comparator means for receiving said smoothed signal and for comparing it with said threshold level and for providing the output signal of predetermined form, upon said smoothed signal exceeding said threshold level, and means for receiving said output signal for generating an alarm operation signal in response thereto.

This invention also provides a method of detecting plate clashing in disc refiners which comprises: determining the frequency at which a significant increase in signal level occurs during a plate clash, by the formula $$f_o = n^{\Sigma}{}_R$$

wherein $f_o$ = a clash frequency (expressed in Hertz)

n = the number of segments, at a given radius per single disc and $\Sigma_R$ = the sum of the rotation rates (expressed in Hertz) of two adjacent discs enclosing a given volume, monitoring the acoustic of vibration frequencies of the disc refiner; continuously determining the signal level of the acoustic or vibration frequencies; continuously comparing the signal at said determined frequency with a predetermined threshold signal prior to the plate clash; and automatically signaling when the signal level exceeds the threshold level.

3. Other Features of the Invention

By one variant thereof, the signal smoothing means is connected to the output of the filter means and is adapted to receive said filtered signal and provide a varying D.C. voltage output signal to the comparator which is related to the average amplitude of said filtered signal; the means for establishing a threshold level comprising adjustable D.C. voltage supply means for providing a D.C. threshold signal.

By another variant, the system includes a vibration sensor mounted on said refiner for sensing vibration and for generating said first signal in response thereto.

By a further variant, the system includes an accelerometer mounted on said refiner for sensing axial vibration and for generating said first signal in response thereto.

By yet another variant, the system includes a microphone for generating said first signal.

By another feature, the predetermined frequency is the fundamental frequency related to the clash, the number of segments at a given radius of a single disc and the rotational rates of the disc.

By still another feature, the predetermined frequency is a harmonic frequency of the fundamental frequency related to the clash, the number of segments at a given radius of a single disc and the rotational rates of the discs.

GENERALIZED DESCRIPTION OF THE INVENTION

The basis of broad aspects of the present invention was the discovery of the inter-relationship between the power spectral densities of the vibration and acoustic signals, and a clash of refiner plates. During a clash, the power in certain frequency bands increases significantly over that observed under normal running conditions. The frequency bands over which the most interesting changes occur stretch from just above D.C. to 2.5 KHz for an acoustic signal and to 7 KHz for a vibration signal. The vibration signal can be derived from a commercially available accelerometer placed strategically for monitoring vibrations, preferably in the axial direction of the refiner, or located or imbedded in the refiner casing, while the acoustic source can be a microphone in proximity to the unit. Indeed, there may be evidence that the distinct signal frequencies related to a clash occur just prior to a clash.

In the use of the broad concepts of this invention, a maximum energy threshold is established over a chosen frequency band for each signal type (vibration or acoustic) which is only exceeded during plate clashing. By monitoring the translated voltage or current output level of the vibrational or acoustic sensors in the selected band, the plate clash alarm is initiated when the respective threshold level is crossed. The width of the frequency band is a trade-off between the need to monitor all frequencies at which significant changes in power level occur (for stability and repeatability of the alarm) and the need to keep the band narrow substantially to eliminate frequencies which have no role (for noise elimination, sensitivity and reliability). The threshold level is established taking into consideration the necessity of detecting all plate clashes and, at the same time, minimizing false alarms.

The basis for the discovery upon which broad aspects of the present invention is based was originally derived from the observed operation of a Sprout-Waldron, 12,000 horsepower, Twin-50 refiner. However, it is equally applicable to other refining units having discs which rotate relative to each other.

The increase in signal power during the period of a plate clash was noted from an analysis of the acoustic and vibration data. However, a superiority of the vibration signal over the acoustic one in the power analysis was found to exist. Because of the greater stability of the power level in the vibration signal during normal refiner operation, and its more rapid increase on the occurrence of a clash, the use of a vibration monitor as the signal source is preferred, although the invention is not restricted thereto.

To provide effective plate clash protection, an appropriate frequency band over which the sensor signal voltage can be measured must be specified. Ideally, the selected band should be independent of the refiner type and should be predetermined such that no adjustment is required at the mill site. As a band suitable for all refiner types may not exist, it is preferable to be able to specify it by its relationship to certain characteristics of the refiner to be protected. It has not been possible to locate a single frequency band that is known to be suitable for use with all disc refiners tested. However, for all refiners tested, certain major modes of vibration have been noted and, for most, it has been possible to relate these to the plate configuration and the disc rotation rate.

During plate clash, most refiners exhibit pronounced peaks in vibration energy at frequencies given by either the passing rate of the disc segments, $f_o$, or its harmonics. These frequencies are of particular importance for this application due to their relative frequency stability, and their peaking effect during a clash. For a given refining volume, the frequency of vibration $f_o$ is defined by:

$$f_o = [\text{the number of segments, at a given radius, per single disc}] \times [\text{the sum of the rotation rates of the two discs enclosing the given refining volume}] \quad (1)$$

assuming that the number of segments per disc is identical. For these refiners, the required frequency during plate clashing is selected on the basis of the exhibited modes of vibration during clashing, with Equation (1) serving as the basis for the frequency search. Frequency selection for all other refiners is done experimentally, with a thorough analysis of the respective vibration signal.

DESCRIPTION OF PREFERRED EMBODIMENTS

Figure 1:
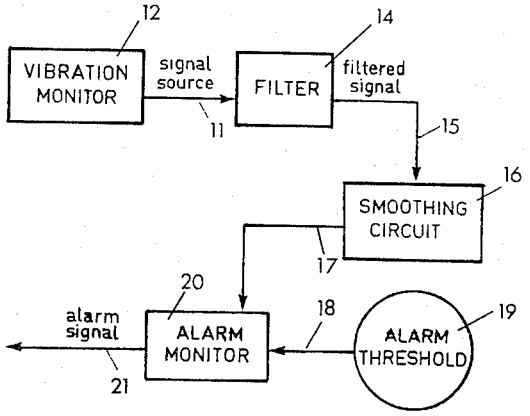
FIG. 1 is a block diagram of an embodiment of the plate clash detector system of one aspect of this invention.

Description of FIG. 1

As seen in FIG. 1, a signal source 11, which may be the output of a sensor which is a vibration monitor 12, e.g., an accelerometer or the output of a microphone located adjacent to the discs is fed to a filter 14 (e.g. preferably a 4 pole Butterworth filter) which has a center frequency $f_c$ and a bandwidth W. The filtered signal 15 is smoothed in smoothing circuit 16. The signal 17 of the smoothed filtered signal is compared with a predetermined threshold level 18 from alarm signal threshold circuit 19. If the signal level 17 equals or exceeds the threshold level 18, an alarm monitor circuit 20 is activated, and an alarm signal 21 is provided.

Figure 2:
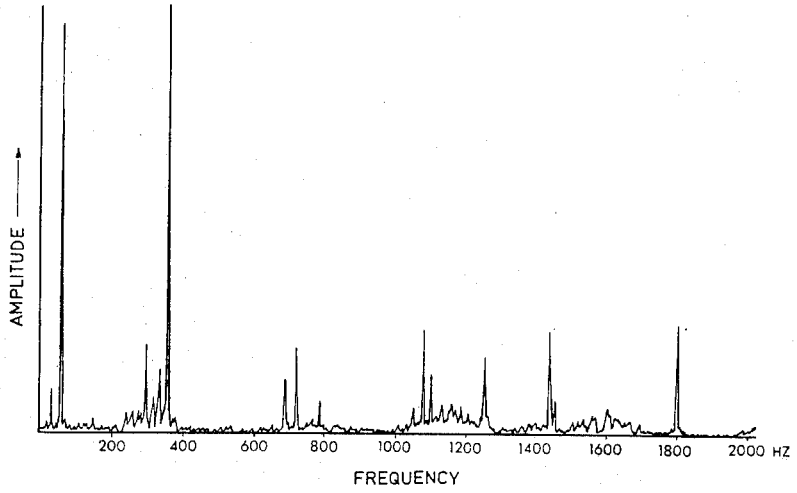
FIG. 2 is a graph of a typical output signal amplitude of a vibration sensor against frequency.

Description of FIG. 2

FIG. 2 shows the amplitude vs. frequency of typical output signals from a vibration monitor during plate clashing. The signal is generally of low amplitude across the lower portions of the audio frequency band and in the absence of clashing, would be at the approximate low amplitude across the entire band.

However, upon clashing of the plates, it has been found that relatively very high amplitude signals occur at specific frequencies (which will be discussed in more detail below). In the present example of FIG. 2, there is clearly a well-defined peak at 360 Hertz (as well as at 120 Hertz).

Operation of Embodiment of FIG. 1

In use, the signal from either a vibration or acoustic sensor which forms the vibration monitor is passed through a filter having centre frequency $f_c$ and bandwidth W, both $f_c$ and W being matched to the frequency of the signals produced upon clashing of the discs. The centre frequency of the filter for the signal spectrum shown in FIG. 2 should thus be at 360 Hertz.

After filtering, the signal is smoothed (for example, by converting the RMS level to a D.C. voltage level) which signal is then compared with a predetermined threshold signal (i.e. a D.C. threshold voltage). If the threshold level is exceeded, some form of alarm is activated or protective action is taken, as desired. The system can be implemented using hardwired circuitry (analog or digital), an appropriately programmed digital computer, or a hybrid of each.

There are various electrical circuits that can achieve the objects described above. In one particular embodiment shown in block diagram in FIG. 1, the input signal is provided by a commercially available accelerometer which is mounted to monitor axial vibrations on the refiner casing, powered by a constant current source of conventional construction. This input signal is then filtered by a filter, with one or more passband frequencies set such that the vibrational frequencies within the desired monitoring bank are passed unattenuated. A gain stage raises the signal level to an appropriate value, for ease of detection, and this signal is RMS-to-DC converted to obtain a smoothed varying D.C. signal level. The D.C. signal is applied to a comparator with a reference D.C. threshold signal, which triggers downstream alarm circuits when the threshold level is exceeded. A visible and audible alarm can be provided to alert the refiner operator. Additionally, a relay is preferably provided which can be used either automatically to open the refiner plates or to reduce the refining pressure, when a clash is identified. The audible alarm and protection relay, once triggered, should be reset by the operator, while the visible alarm turns ON and OFF with the alarm condition.

Figure 3:
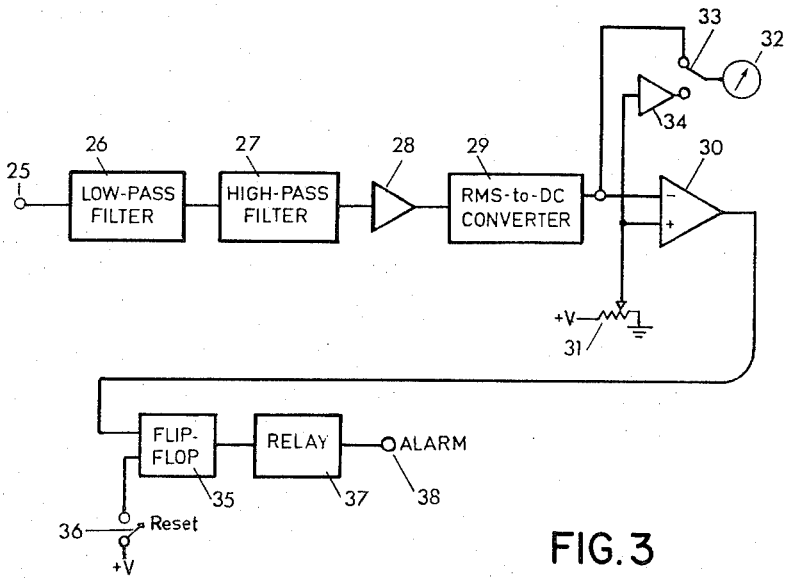
FIG. 3 is a more detailed block diagram of an aspect of this invention.

Description of FIG. 3

A more detailed block diagram of an aspect of this invention is shown in FIG. 3. An input signal from the vibration monitor, which can be either an accelerometer, microphone, etc. as noted earlier is applied to input terminal 25. The bandwidth of the accelerometer should extend at least between 1 and 7,000 Hertz, which includes all of the frequencies of interest in the present case.

The specific translation bandwidth of the circuit is preferably defined by a bandpass filter. This can be implemented by using a series of a pair of filters, the first being a low pass filter 26 connected to the input of a high pass filter 27, with the input terminal 25 connected to the input of low pass filter 26. Of course, filters connected in parallel can be used to pass different frequencies of the signal related to the clash.

Preferably, the high frequency band-end of the low pass filter is variable, as is the low frequency band-end of high pass filter 27. By varying the band-ends, a passband can be produced which has a frequency width sufficient to encompass the peaking vibrational signal produced during a clash, and having a centre frequency at the midpoint of the peaking signal.

The output of high pass filter 27 is connected to the input of an amplifier 28, the output of which is applied to the input of an RMS-to-DC converter 29. The output of the RMS-to-DC converter 29 is connected to one input of comparator 30, the other input of which is connected to an adjustable D.C. voltage source, e.g., the tap on potentiometer 31 which is connected between ground and a source of potential +V.

It is also preferred that the output of the RMS-to-DC converter 29 should be connected to the input of a voltmeter 32 through a switch 33. The voltmeter 32 is also connected to the tap of potentiometer 31 through an amplifier 34 and switch 33.

The output of comparator 30 is connected to one of the inputs of a bistable flip flop 35, the other input of which is connected through a reset switch 36 to a source of potential +V.

The output of flip flop 35 is connected to a relay 37 which has its contact connected to an alarm terminal 38 for operation thereof.

In operation, the normal signal outputs of the sensor, which are at low level as shown in FIG. 2, are applied to terminal 25 of the plate clash monitor. The signals are filtered in low pass and high pass filters 26 and 27, and are normally at low amplitude voltage level.

However, in the case of a plate clash, a relatively high level signal at the frequency of the bandpass of the combination of filters 26 and 27 is generated, and passes therethrough. The signal at this frequency is amplified in amplifier 28, and applied to RMS-to-DC converter 29.

In converter 29 the signal is effectively smoothed, and a relatively constant, or relatively slowly varying D.C. signal is applied to comparator 30.

The other input of comparator 30 has a preset threshold D.C. signal applied thereto. Once the output signal of converter 29 exceeds the aforenoted threshold signal, an output signal is produced from comparator 30 and is applied to the input of flip flop 35. With the polarity of the input signals from comparator 30 being proper, flip flop 35 operates and remains stable in the operated state. An output signal thus results and is applied to relay 37, which itself operates and remains on. With its contacts closed, an alarm connected to terminal 38 is thus operated and remains operated.

Once an operator has become alerted, and wishes to shut-off the alarm, he manually closes reset switch 36, which resets flip flop 35 into its original state. The output signal of flip flop is thus removed, (unless further clashing of the plates is encountered), and thus relay 37 is released, shutting off the alarm.

One relatively simple way of setting the alarm threshold level is to place switch 33 in position by which meter 32 monitors the D.C. output signal of converter 29. The highest level D.C. signal is monitored during the non-clashing periods. In addition, the minimum high amplitude signal level is noted during a clashing period.

Switch 33 is then switched into position at the output of amplifier 34. Amplifier 34, being a unity gain buffer amplifier, does not change the level of the D.C. voltage signal which is input to the comparator and is read on meter 32. Potentiometer 31 is then adjusted to a level intermediate the highest level normal D.C. output signal from converter 29 and the lowest level signal present during clashing. Of course other ways of setting the threshold can be utilized if desired.

Description of other Variants

It will be understood by a person skilled in the art that numerous variations and additions to the circuit noted above can be provided. For example, while comparator 30 has been described as being in analog form, it can be strobed and its output signal be of pulse form. Flip flop 35 can operate in synchronization therewith, and operate an audible alarm with its output pulses directly. Other means can be used to lock up a relay (either electromagnetic or solidstate) whereby a constant alarm which must be manually reset is operated.

The accelerometer may be that sold by Unholtz-Dickie as Model 8803 accelerometer with magnetic base. The filter may be a series of a low pass filter and a high pass filter to define the passband; the low pass filter may be that sold by Frequency Devices as Model 744PB-3, a four pole Butterworth low pass filter. The high pass filter may be that sold by Frequency Devices as Model No. 774BT-3, a four pole Butterworth resistive tuneable highpass filter. The RMS-to-DC converter may be that sold by Analog Devices as Model No. 441J.

EXAMPLES AND TRIALS OF EMBODIMENTS OF THE INVENTION

Description of Tests and Trials

A series of trials have been carried out to elucidate the range of application of the described sensor. Both the distinctiveness of the clash phenomena as well as the possibilities for frequency band selection were examined, for various refiner types. The lack of a good sensor for measuring plate separation makes it difficult to guarantee when plate clashing actually occurs. Consequently, the described frequency phenomena was related to plate clashing in three ways:

(a) experienced refiner operators were used to help identify a clash occurrence;

(b) linear velocity displacement transducers, LVDT's, were used to monitor plate movement;

(c) forced clashes were initiated without chips, where the only possible contact between the plates was metal-to-metal.

SPROUT-WALDRON TWIN —50 (60 Hertz Supply)—Eight clashes were studied. The accelerometer was located on the refiner casing, measuring vibration in either the axial or radial direction. Along with the vibration signal, the motor load, the chip-belt speed and a measure of plate movement from an LVDT were recorded. It was found that:

(i) At a frequency of 360 Hz, there was a pronounced increase in the amplitude of the vibration during a clash.

(ii) The total energy in the signal (the integral over frequency of the vibration spectrum) did not vary significantly during a clash.

(iii) Using Equation (1), the number of plate segments (12) multiplied by the rotation speed (30 Hz) located the dominant vibration mode, 360 Hz.

(iv) Better clash detection resulted with the accelerometer measuring vibration in the axial direction.

SPROUT-WALDRON TWIN-50 (50 Hertz Supply)—Results are similar to those obtained with this refiner operating from a 60 Hz supply, excepting the location of the dominant vibration mode. The dominant frequency was 300 Hz, equal to the product of rotation speed (25 Hz) and the number of plate segments (12).

SPROUT-WALDRON 42-1A—Two clashes were analyzed, with the accelerometer measuring axial vibration. It was found that:

(i) the first clash gave rise to three large peaks at 720, 1440 and 2160 Hz, respectively.

(ii) The second clash showed a dominant peak at 2160 Hz.

(iii) The energy peaks were located at frequencies that are integral multiples of 360 Hz, the product of rotation speed and the number of plate segments.

SPROUT-WALDRON 42-1B—Three separate trials were conducted on this refiner, with the following results:

(i) A peak at 360 Hz was always present during clashing.

(ii) The total energy in the vibration signal could diminish during a clash; nevertheless, the amplitude of the vibration at 360 Hz still increased.

(iii) The rotation speed (30 rotations per second) multiplied by the number of segments (12) located the 360 Hz mode.

SPROUT-WALDRON 361-CP (Pressurized)—Two clashes were observed, with the sensor measuring axial vibration. A distinct peak at 610 and 625 Hz was noted for each, respectively. It was also noted that:

(i) There was a slight shift in frequency between the clashing and non-clashing conditions, likely caused by a small change in the speed of rotation of the induction motor.

(ii) The noted frequencies could not be related to the rotation speed of the disc and the number of segments, using Equation (1). However, it is believed that this is due to rotational speed changes of the disc due to the clash.

BAUER 400—This is a double-disc refiner driven by two induction motors. The nominal speed of disc rotation is 1200 RPM and each refining plate is made up of six segments. It was found that:

(i) With both discs rotating, a major energy peak was located between 215 and 240 Hz, during a clash. The latter frequency was equivalent to the product of the number of segments per plate (6) and the sum of the rotation frequency of each of the two counter-rotating discs (40 Hz).

(ii) There was a slight shift in the peaking frequency and this was related to variations in the rotation speed of the induction motors during clashing.

(iii) For certain clashes, the second harmonic (480 Hz) of the characteristic frequency appeared as the main mode of vibration. For others, the characteristic frequency, the second harmonic, or both, could be present.

(iv) With only one disc rotating, a major peak was found around 100 Hz, during clashing. This was lower than the expected frequency of 120 Hz and it is thought that this may be due to variations in the rotational speed of the disc.

BAUER 412—Vibrations were measured in the axial direction. A peak in energy is found at 480 Hz, which is the second harmonic of the frequency calculated using Equation (1).

DEFIBRATOR RPL50—Each disc plate on this refiner has three different sections. The outer one has 12 segments, the middle section has eight and the inner section has four. The middle section on the stationary disc can be moved slightly in the axial direction. Tests were made with the sensor monitoring axial vibration. It was found that:

(i) There was a large peak at 960 Hz, surrounded by peaks of smaller amplitude, 30 Hz apart.

(ii) A vibration peak also occurred at 480 Hz, suggesting that the middle section of the discs, made up of eight segments, were contacting. Using Equation (1), the base frequency calculated was 240 Hz for 8 sections and 30 Hz rotation.

DEFIBRATOR RPL50 (Pressurized)—The disc configuration is the same as that described previously. With the sensor measuring vibration in the axial direction, a series of peaks were again evident, with the one at 720 Hz particularly outstanding at the beginning of the clash. The minor peaks are again 30 Hz apart. This suggests that the outer part of the disc, with 12 segments, was clashing.

Summary of Test Results

The results of these various tests, together with the expected peaks calculated using Equation (1), are listed in Table 1.

TABLE 1

Summary of Test Results; Refiner Clashing.

| REFINER TYPE | DISC ROTATION RPM/RPS | NO. OF ROTATING DISCS | SEGMENTS PER DISC, AT GIVEN RADIUS | $f_o$ Hz | OBSERVED PEAKS(Hz) |
|---|---|---|---|---|---|
| Sprout-Waldron Twin-50 (60 Hz) | 1800/30 | 1 (per volume) | 12 | 360 | 360 |
| Sprout-Waldron Twin-50 (50 Hz) | 1500/25 | 1 (per volume) | 12 | 300 | 300 |
| Sprout-Waldron 42-1A | 1800/30 | 1 | 12 | 360 | 720<br>1440<br>2160 |
| Sprout-Waldron 42-1B | 1800/30 | 1 | 12 | 360 | 360 |
| Sprout-Waldron 361-CP | 1800/30 | 1 | 9 | 270 | 610<br>630 |
| Bauer 400 | 1200/20 | 2 | 6 | 240 | 215<br>240 |
| Bauer 412 | 1200/20 | 2 | 6 | 240 | 480 |
| Defibrator (Open-Discharge) | 1800/30 | 1 | 4-Inner<br>8-Middle<br>12-Outer | 120<br>240<br>360 | 960 |
| Defibrator (Pressurized) | 1800/30 | 1 | 4-Inner<br>8-Middle<br>12-Outer | 120<br>240<br>360 | 720 |

Vibration measurements in the axially direction were generally found to give better results than those in the radial. Except for some preliminary trials, the sensor was always located as close as possible to the refining chamber, wherein the alarm frequencies originate. In the case of the Sprout-Waldron Twin-50, sensor position is more crucial as there are two refining chambers to monitor; identification of the clashing disc-set is important in those situations where clashing can be prevented by the adjustment of either the chip feed rate or the dilution water flow. It may be advantageous to use two vibration sensors, one to monitor each refining chamber, to identify the clashing set.

In summary, tests have been carried out on fourteen refiners, of nine different types. Clashing has been initiated by either reducing the chip feed or by forcing the plates closer together. In all cases, the vibration signal exhibits a very large increase in amplitude at specific frequencies, at the time of plate clash. With one exception, the Sprout-Waldron 361-CP, observed frequencies were equal to either a fundamental frequency, $f_o$, or its harmonics. The Sprout-Waldron Twin-50, as well as the 42-1B, show high vibration energy at the fundamental frequency, $f_o$. All other refiners tested, excepting the Sprout-Waldron 361-CP, have a major vibration mode at the second harmonic of the fundamental frequency.

The Bauer 400 peaks at the expected fundamental frequency. The second harmonic, however, is often the dominant one.

The ease and reliability of vibration measurement makes the use of an accelerometer very desirable. It was noted that there were very distinct changes in the frequency spectrum of the vibration signal at the time of plate clashing. It was observed that the total energy in the vibration signal, over the total frequency range analyzed (0 to 5,000 Hz), tended either to increase or to remain constant during plate clashing. There were instances, nonetheless, where this total energy was reduced. In all cases, however, the energy level at the characteristic frequency, $f_o$, or its harmonics always increased during clashing.

Summary

From the foregoing description, one skilled in the art can easily ascertain the essential characteristics of this invention, and without departing from the spirit and scope thereof, can make various changes and modifications of the invention to adapt it to various usages and conditions. Consequently, such changes and modifications are properly, equitably, and "intended" to be, within the full range of equivalence of the following claims.

We claim:

1. A refiner plate clash detection system comprising:

(a) means for receiving a first signal having a significant increase in level at at least one distinct predetermined frequency related to the clash and the characteristics of the discs of the refiner, (b) filter means having a passband matched to pass said distinct frequency of said signal to provide a filtered output signal in which the center frequency of the passband of the filter is determined by the formula $$f_o = n\,\Sigma_R$$

wherein $f_o$ is the center frequency (expressed in Hertz) of said passband n = the number of segments at a given radius, per single disc and $\Sigma_R$ = the sum of the rotational rates (expressed in Hertz) of the two discs enclosing a given refining volume, (c) means for smoothing said filtered signal, (d) means for establishing a threshold level, (e) comparator means for receiving said smoothed signal and for comparing it with said threshold level and for providing an output signal of predetermined form, upon said smoothed signal's exceeding said threshold level, and (f) means for receiving said output signal for generating an alarm operation signal in response thereto.

2. A refiner plate clash detection system as defined in claim 1 in which said signal smoothing means is connected to the output of the filter means and is adapted to receive said filtered signal and provide a varying D.C. voltage output signal to the comparator which is related to the average amplitude of said filtered signal; the means for establishing a threshold level comprising adjustable D.C. voltage supply means for providing a D.C. threshold signal.

3. A refiner plate clash detection system as defined in claim 1 further including a vibration sensor mounted on the refiner for sensing vibration and generating said first signal in response thereto.

4. A refiner plate clash detection system as defined in claim 1 further including an accelerometer mounted on the refiner for sensing axial vibration and for generating said first signal in response thereto.

5. A refiner plate clash detection system as defined in claim 1 further including a microphone for generating said first signal.

6. A refiner plate clash detection system comprising:

(a) means for receiving a first signal having a significant increase in level at at least one distinct predetermined frequency related to the clash, the number of segments at a given radius of a single disc and the rotational rates of the discs, (b) filter means having a passband matched to pass said distinct frequency of said signal to provide a filtered output signal, (c) means for smoothing said filtered signal, (d) means for establishing a threshold level, (e) comparator means for receiving said smoothed signal and for comparing it with said threshold level and for providing an output signal of predetermined form, upon said smoothed signal's exceeding said threshold level, and (f) means for receiving said output signal for generating an alarm operation signal in response thereto.

7. A refiner plate clash detection system as defined in claim 6, wherein said predetermined frequency is the fundamental frequency related to the clash, the number of segments at a given radius of a single disc and the rotational rates of the disc.

8. A refiner plate clash detection system as defined in claim 7, where said predetermined frequency is a harmonic frequency of the fundamental frequency related to the clash, the number of segments at a given radius of a single disc and the rotational rates of the discs.

9. A method of detecting plate clashing in disc refiners which comprises:

determining the frequency at which a significant increase in signal level occurs during a plate clash, by the formula $$f_o = n\,\Sigma_R$$

wherein $f_o$ = a clash frequency (expressed in Hertz)

n = the number of segments, at a given radius per single disc and $\Sigma_R$ = the sum of the rotation rates (expressed in Hertz) of two adjacent discs enclosing a given volume, monitoring the acoustic or vibration frequencies of the disc refiner;

continuously determining the signal level of the acoustic or vibration frequencies;

continuously comparing the signal level at said determined frequency with a predetermined threshold signal prior to the plate clash; and automatically signalling when the signal level exceeds the threshold level.

10. A method of detecting plate clashing in disc refiners which comprises:

determining the frequency at which a significant increase in signal level occurs during a plate clash, which distinct frequency is related to the clash, the number of segments at a given radius of a single disc and the rotational rates of the discs;

monitoring the acoustic or vibration frequencies of the disc refiner;

continuously determining the signal level of the acoustic or vibration frequencies;

continuously comparing the signal level at said determined frequency with a predetermined threshold signal prior to the plate clash; and automatically signalling when the signal level exceeds the threshold level.

* * * * *